United States Patent [19]

Debaigt

[11] 3,970,276

[45] July 20, 1976

[54] DEVICE FOR FIXING AN OBJECT

[75] Inventor: Jean Debaigt, Maisons-Laffitte, France

[73] Assignee: C.G.E.E.-Alsthom, Levallois-Perret, France

[22] Filed: Nov. 10, 1975

[21] Appl. No.: 630,125

[30] Foreign Application Priority Data

Nov. 25, 1974 France ..... 74.38587

[52] U.S. Cl. ..... 248/223; 339/198 GA

[51] Int. Cl.[2] ..... H01R 9/22

[58] Field of Search..... 248/223, 224, 506, 27 R; 85/80, 5 R; 339/128, 198 H, 198 GA

[56] References Cited

UNITED STATES PATENTS

| | | | |
|---|---|---|---|
| 3,236,975 | 2/1966 | DeSmidt et al. | 339/198 GA X |
| 3,278,145 | 10/1966 | Leshuk | 248/223 X |
| 3,430,190 | 2/1969 | Verneau | 339/198 GA |
| 3,662,298 | 5/1972 | Gillissen | 339/198 GA |
| 3,753,216 | 8/1973 | Johnson | 339/198 GA |
| 3,809,799 | 5/1974 | Taylor | 248/223 X |

*Primary Examiner*—J. Franklin Foss

*Attorney, Agent, or Firm*—Sughrue, Rothwell, Mion, Zinn & Macpeak

[57] ABSTRACT

Device for fixing an object on a support formed by spaced parallel edges, forming an insertion face for the insertion of the device between those edges, an opposite face to the insertion face and a rim, has two opposite sides each co-acting with one of the edges of the support, a lateral stop on each side which is fixed and faces the fim facing the support, a flexible clip presses against the insertion face of the corresponding edge of the support, a rigid clip is arranged against the opposite face and a ratching and locking member locks the device on the support on one of the sides.

8 Claims, 3 Drawing Figures

DEVICE FOR FIXING AN OBJECT

BACKGROUND OF THE INVENTION

1. Field of the Invention

The invention relates to a device for fixing an object on a support.

2. Description of the Prior Art

Various devices for fixing objects, like electrical equipment such as terminals and connectors, on supports such as angle bars or panels, have already been proposed. Among these, the fixing device according to British patent No. 1 108 820 and U.S. Pat. No. 3,430,190 is an example.

These devices which ratch automatically on their support are very practical, but they nevertheless have certain disadvantages. On the one hand, they are suitable for being fixed only on a support having a thickness which is necessarily well-defined. Should the support have another thickness, the correct ratching then requires a correction of the edges of the support, but in any case, the permissible variation in the thickness of the support remains very limited. On the other hand, the locking of the ratching position is only relative, for an untimely effort on the object is always liable to cause the unratching of the object from the support.

The present invention has as its object a device for fixing an object on a support, which ensures a good fixing of the object and adapts itself to fairly great variations in the thickness of the support. Moreover, that device can easily be provided whith an unlocking lever.

SUMMARY OF THE INVENTION

The invention has as its object a device for fixing an object-on a support formed by laterally opposed parallel edges comprising a face for the insertion of the object between those edges, an opposite face to the insertion face and two rims each formed by one of the edges, the said object comprising two opposite sides each co-acting with one of the edges of the support, characterized in that the object comprises, on each side, a fixed lateral stop which presses against the rim facing the support and, on a first side, a first flexible tab pressing against the insertion face of a first edge of the support and a rigid tab coming against the opposite face of that edge and, on the second side, a second flexible tab pressing against the insertion face of the second edge of the support and a ratching tab ratching on the opposite face of that second edge.

The ratching tab is, to great advantage, a tab which can flexibly be brought closer to the second side of the object and which bears a ramp ending in a cusp, that ramp pressing against the rim of the second edge, so that as the object is inserted in the support, the ratching tab first comes nearer to the said second edge as long as the ramp slides on the rim, then moves suddenly away to press the cusp against the opposite face of the second edge.

The insertion of the object in the support is effected first by engaging the first side of the object in the first edge of the support, the object being inclined, then the second side is locked on the second edge by the ratching tab when the object already engaged in the first side is set upright again.

The engaging of the first side is particularly easy if the first flexible tab and the rigid tab have their free ends respectively closer to and further from the lateral stop of that first side. Thus, when the object is inclined, the first edge of the support easily enters the opening situated between those two free ends, whereas that first edge is, on the contrary, gripped between those free ends when the object is set upright.

According to another characteristic, an unlocking lever is arranged on the free end of the ratching tab.

The characteristics and advantages of the invention will become apparent from the description of an embodiment given by way of an example and illustrated in the drawings.

DESCRIPTION OF THE PREFERRED EMBODIMENT

Figure 1:
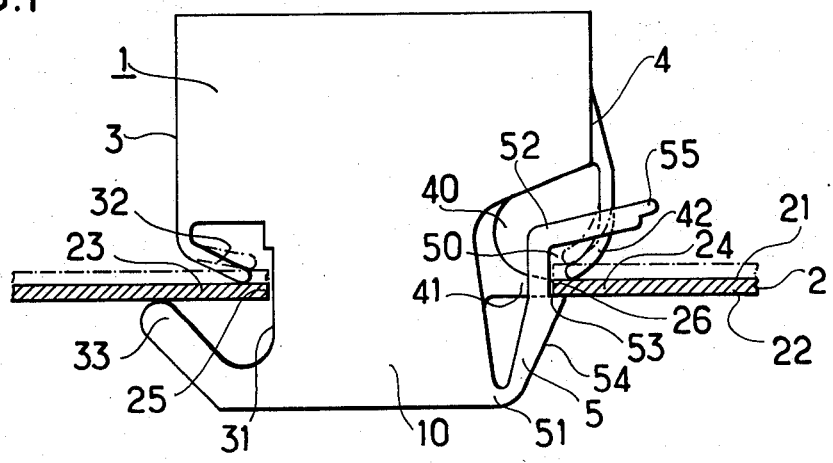
FIG. 1 is a transversal profile view of a device according to the invention.
Figure 2:
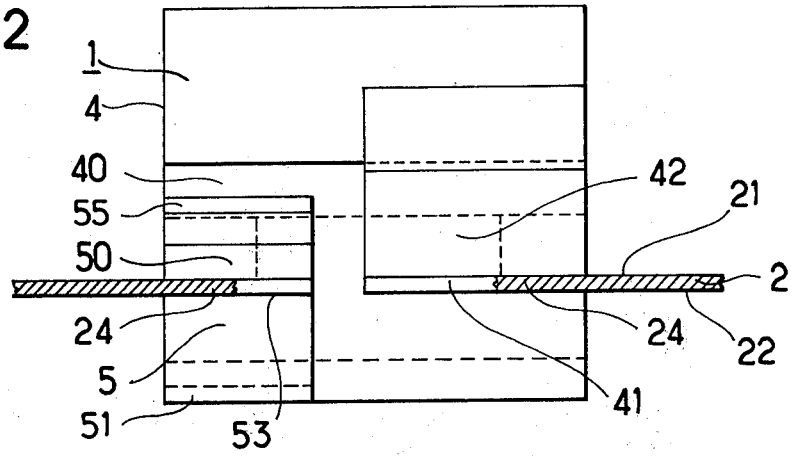
FIG. 2 is a front view of the right-hand side according to FIG. 1.

In the figures, an object fixed through an opening formed in a support 2 made of sheet metal, having at its top part, an insertion face 21 and at its bottom part, an opposite face 22 has been designated by the numeral 1.

The support 2 represents two parallel edges 23 and 24 limited by two parallel rims 25 and 26.

The object 1 comprises, at its base, a fixing device arranged at both its sides 3 and 4. The left-hand side 3 is arranged facing the rim 25 and the right-hand side 4 is facing the rim 26.

The side 3 comprises a lateral stop 31, a flexible tab 32 and a rigid tab 33. The stop 31 of the object is applied against the edge 25 ; the end of the flexible tab 32 is arranged bearing along the edge 23 against the insertion face and the end of the rigid tab 33 is arranged bearing along the edge 23 against its opposite face.

The side 4 comprises a lateral tab 41, a flexible stop 42 and a ratching clip 5. The stop 41 constitutes a protrusion applied against the rim 26 and the flexible tab 42 is applied along the edge 24 the insertion face. The stop 41 and the flexible tab 42 take up only a fraction of the width afforded by the side 4; that fraction is limited by a recess 40 formed in the remaining fraction of the side 4. The recess 40 contains the flexible tab 5 articulated round a ridge 51 parallel to the rim 26 and arranged at the bottom part of the base 10 of the object.

The free end 52 of the tab 5 carries a notch 50 arranged facing the rim 26. The bottom of that notch 50 is applied against the rim 26 and comprises a cusp 53 which is arranged to press against the opposite face of the edge 24. The tab 5 can be deformed flexibly round its articulation 51 transversally to the rim 26 and it has a ramp 54 inclined towards the rim 26. Its end 52 is provided with a manoeuvring lever 55.

Figure 3:
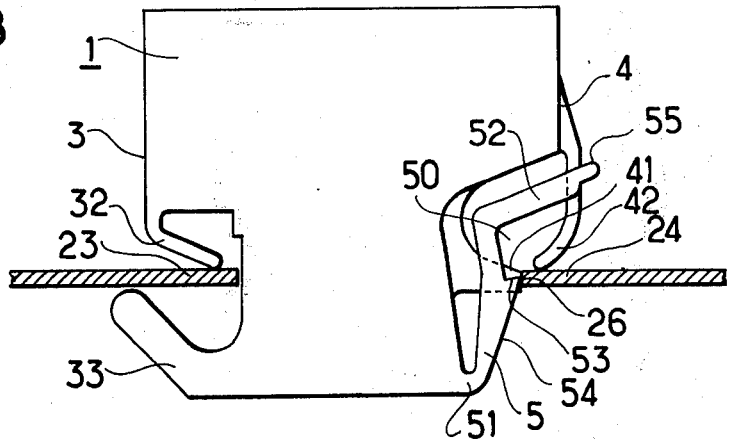
FIG. 3 is a view of the device according to FIG. 1 during insertion.

The operation of the fixing device is as follows:

First, the base of the inclined object is inserted, through the opening of the support 2, into the insertion 21 and the rim 25 is engaged in the space comprised between the tabs 32 and 33, whose ends are staggered one relative to the other in relation to the stop 31, until the rim 25 comes into contact with the lateral stop 31. The part of the tab 5 adjoining its articulation 51 is then engaged against the rim 26 and it is made to slide along the ramp 54, whereas it brings the object upright, this having effect of pushing the tab 5 back into the recess 40. As the distance between the two lateral stops 31 and 41 corresponds to the width of the opening, that is, to the distance between the rims 25 and 26, the cusp 53 is retracted to the right of the protrusion on the stop 41, as will be seen in FIG. 3. The movement is continued until the rim 26 parts from the cusp 53; then, the flexible tab is released and the cusp 53 is automatically placed against the opposite face of, the edge 24 and the fixing device is ratched. In that position, the edges 23 and 24 of the support 2 are gripped between the fixed tabs 33 and 53 on the one hand the flexible tabs 32 and 42 on the other hand and the object is laterally well kept in place by the stops 31 and 41.

That fixing entails a well-determined opening distance of the support, but the clamping afforded by the flexible tabs 32 and 42 in co-operation with the fixed tabs 33 and 53 allows variable support thicknesses depending on the extent to which the height of the notch 50 above the cusp 53 exceeds the thickness of the support. Thus it is that FIG. 1 shows in discontinuous lines the clamping of a support having a greater thickness.

On the other hand, the device, once it is ratched, cannot be disengaged under the effect of an untimely effort or shock, for the cusp 53 can be released only under the positive effect of an effort exerted on the free end 52. To remove the fixing device from the support, it is necessary only to exert a pressure on the free end 52 either with a finger, by means of the lever 55, or by means of a tool such as a screw driver.

It is evident that the invention is in no way limited to the embodiment which has just been described and illustrated and which has been given only by way of an example; indeed, without beyond the scope of the invention, certain arrangements can be modified or certain means can be replaced equivalent means.

I claim:

1. In a device for fixing an object on a support formed by laterally spaced, parallel edges forming an insertion face for the insertion of the object between those edges, an opposite face to the insertion face and two rims each formed by a respective one of the edges, said object comprising two opposite sides each co-acting with one of the edges of the support, the improvement wherein: the object comprises, on each side a fixed lateral stop which presses against the rim facing the support and, on a first side, a first flexible tab pressing against the insertion face of a first edge of th support and a rigid tab which abuts the opposite face of that edge and, on the second side, a second flexible tab which presses against the insertion face of the second edge of the support and a ratching tab ratching on the opposite face of that second edge.

2. The fixing device, according to claim 1, wherein the ratching tab is such that it is flexibly brought closer to the second side of the object and bears a ramp ending in a cusp, said ramp pressing against the rim of the second edge, so that, as the object is inserted in the support, the ratching tab first comes nearer to said second side as long as the ramp slides on the rim, then moves suddenly away to press the cusp against the opposite face of the second edge.

3. The fixing device according to claim 1, wherein the first flexible tab and the rigid tab have their free ends respectively closer to and further from the lateral stop of the first side such that when the object is inclined, the first edge of the support easily enters the opening situated between those two free ends, and that first edge is, on the contrary, gripped between those free ends when the object is set upright again.

4. The fixing device according to claim 1, wherein an unlocking lever is arranged on the free end of the ratching tab.

5. The fixing device according to claim 2, wherein the first flexible tab and the rigid tab have their free ends respectively closer to and further from the lateral stop of the first side such that when the object is inclined, the first edge of the support easily enters the opening situated between those two free ends, and that first edge is, on the contrary, gripped between those free ends when the object is set upright again.

6. The fixing device according to claim 2, wherein an unlocking lever is arranged on the free end of the ratching tab.

7. The fixing device according to claim 3, wherein an unlocking lever is arranged on the free end of the ratching tab.

8. The fixing device according to claim 5, wherein an unlocking lever is arranged on the free end of the ratching tab.

* * * * *